United States Patent [19]

Gulliksen et al.

[11] 4,438,483

[45] Mar. 20, 1984

[54] UTILITY HANDLAMP AND CHARGING COMPONENT MEANS THEREFOR

[75] Inventors: John E. Gulliksen, Shrewsbury; Roy A. Guimond, Holden; Charles F. Daly, Boylston; William H. Hamilton, Lincoln, all of Mass.

[73] Assignee: Koehler Manufacturing Co., Marlborough, Mass.

[21] Appl. No.: 363,660

[22] Filed: Mar. 31, 1982

[51] Int. Cl.[3] ..... F21L 7/00

[52] U.S. Cl. ..... 362/183; 362/103; 362/186; 362/191; 362/200; 362/368; 362/396

[58] Field of Search ..... 362/183, 103, 186, 191, 362/200, 368, 396

[56] References Cited

U.S. PATENT DOCUMENTS

| | | | |
|---|---|---|---|
| 1,283,566 | 11/1918 | Rosenfeld | 362/201 |
| 1,757,889 | 5/1930 | Wheat | 362/183 |
| 3,015,719 | 1/1962 | Kirkman | 362/199 |
| 3,084,248 | 4/1963 | Packer et al. | 362/199 |
| 3,601,595 | 8/1971 | Kivela | 362/199 |
| 3,711,699 | 1/1973 | Bacevius | 362/197 |

*Primary Examiner*—Stephen J. Lechert, Jr.

*Attorney, Agent, or Firm*—Hamilton, Brook, Smith & Reynolds

[57] ABSTRACT

A utility handlamp, comprising battery jar means having enclosure means detachably secured thereto, is disclosed. Optical control means including light transmitting means, having reflector means affixed thereto, is engaged in threaded, rotatable relationship with a tubular extension of the enclosure means. A light source in the enclosure means may be focused by rotation of the optical control means. Stop means are provided to limit the extent of rotation of the optical control means.

The enclosure body is further provided with a resilient, depending clip element which cooperates with parts of the battery jar means and enclosure means for mounting the handlamp on a belt, pocket, etc. and for providing a plurality of stable positions of the handlamp such that the path of travel of an emitted light beam may be varied along desired directions of angularity.

Charging means including a specially-formed charging interface component is disclosed, which cooperate with the clip element of the handlamp to insure maintained positive electrical connection between the battery means and the charging means.

10 Claims, 17 Drawing Figures

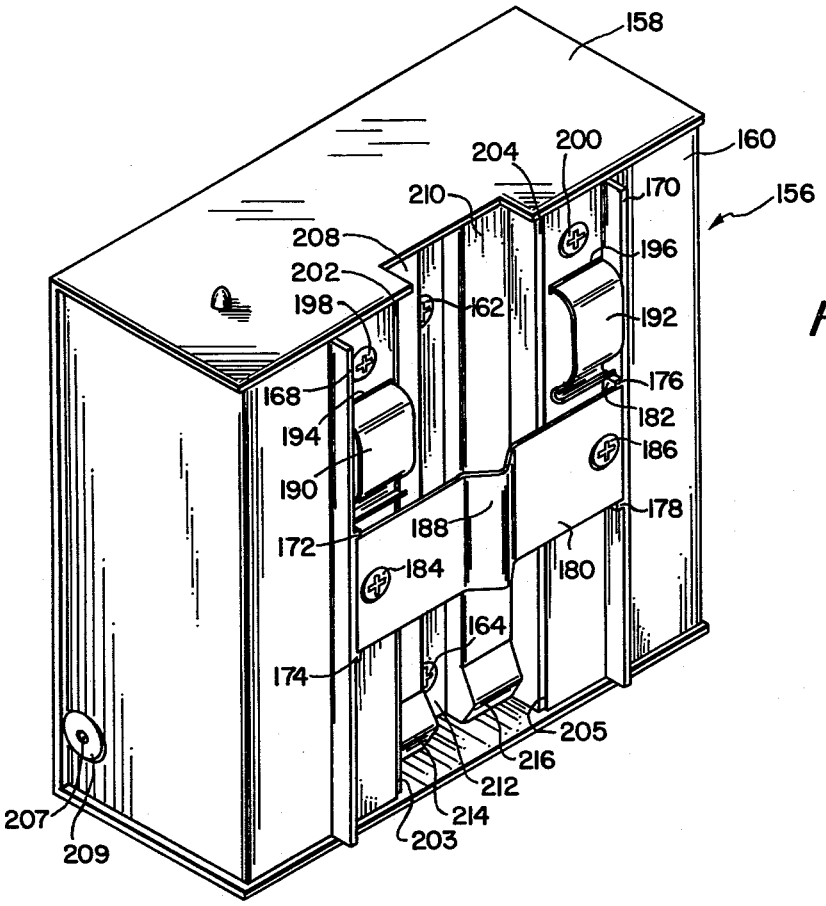
FIG. 15
FIG. 16
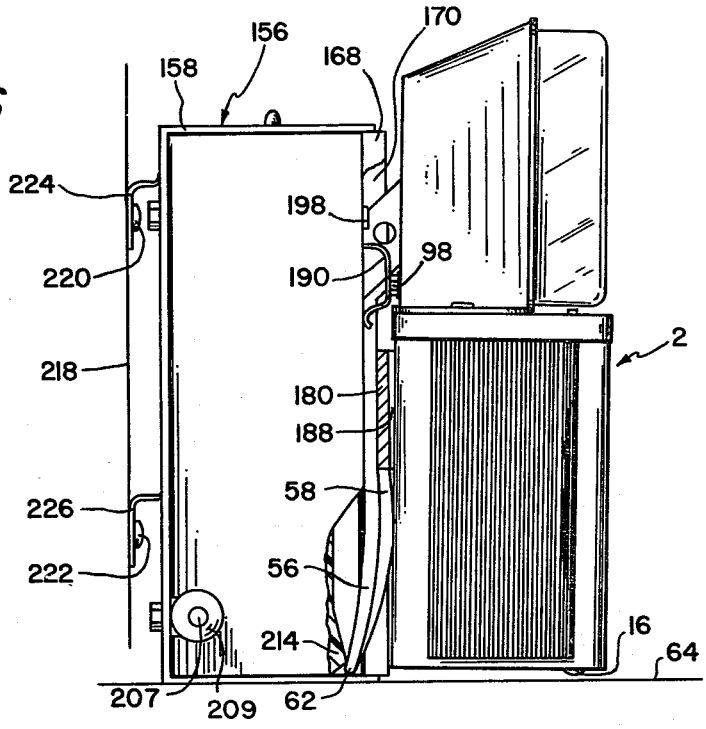

UTILITY HANDLAMP AND CHARGING COMPONENT MEANS THEREFOR

BACKGROUND OF THE INVENTION

Although utility handlamps are well known to the art, such devices as are customarily provided rarely if ever combine desired features of use with simplicity and ruggedness of design. Where such lamps are rechargeable in nature and charging means are provided, similar drawbacks exist in the charging means.

Where focus adjustment of an emitted light beam is provided, this is customarily carried out within the lamp housing by allowing adjustment of the distance between the focal point of a parabolic reflector body and the incandescent filament of a light source. This may be accomplished either by moving the reflector body or by moving the light source and, in either case, such movement is conventionally imparted by lever means, slide means, or cam means. These arrangements generally do not provide a smooth action or precise focus control. In addition, these arrangements tend to be rather complex, with a plurality of extra parts being required for this purpose.

Utility handlamps which provide means whereby the path of travel of an emitted light beam may be varied in desired directions of angularity are also known to the art. Customarily this has been accomplished by mounting a luminaire "head" including light source means, reflector means and light transmitting means in a manner such that the said luminaire head may be rotated or swiveled. Again, this requires a plurality of extra parts and, in some cases, premature failure of the device caused by fatigue of moving parts or wires may result. In addition, such arrangements are not easily mounted for hands-free operation on a belt member.

Charging arrangements for such lamps either include plug-and-receptacle arrangements or wiping contact arrangements. The first of these is failure prone because of the vulnerability of male portions of the arrangement to breakage and of female portions to entry of dirt, which may become compacted therein. Wiping contact arrangements as conventionally provided, on the other hand, are vulnerable to loss of electrical contact, particularly under conditions of vibration of the charging means.

The need for handlamp and charging apparatus which overcomes the drawbacks cited above is particularly evident in certain public safety fields, particularly firefighting. Such apparatus must be focusable to provide a beam which can penetrate dust or smoke, be operable either hand-held or clipped to a belt or pocket, and also be capable of illuminating an overhead area while resting on a supporting surface and where the beam should be adjustable through varying directions of angularity. Such a lamp must be rugged and reliable, with simplicity of design and a minimum of moving parts providing ease of maintenance and use.

In addition, such a lamp should be rechargeable, and the charging arrangement should be easy and quick to use. It is essential that good electrical contact between charging means and the battery of the lamp be maintained, when engaged by the user, through varying conditions which may, for example, include extreme vibration.

SUMMARY OF THE INVENTION

This invention relates to utility handlamps and charging means therefor.

It is a first object of this invention to provide a utility handlamp which may also be operated while mounted on a belt or pocket.

It is a second object of the invention to provide a utility handlamp which may be operated while it is resting on a supporting surface and provide an emitted light beam which may be varied through a plurality of desired directions of angularity.

It is another object of this invention to provide a handlamp which may be focused by the user, and in which the degree of focus adjustment is limited.

A fourth object of this invention consists in providing a utility handlamp in which desired features are provided using a minimum of moving parts.

Still another object of this invention is to provide a handlamp and charger combination which is easy and quick to engage and to disengage and, when engaged, in which electrical connection between charging circuitry and battery means is reliably maintained even under conditions of extreme vibration.

It has been found that these objects may be realized by a handlamp design of unique configuration, the said handlamp including battery jar means having enclosure means detachably affixed thereto, the said enclosure means having a light source means and other associated electrical components received therein and having optical control means affixed thereto in threaded relationship therewith. The optical control means comprises light transmitting means having reflector means affixed to an inner side thereof and carried on the light transmitting means. Rotation of the light transmitting means moves the reflector means with respect to the light source means to accomplish passing of an emergent light beam.

In addition, the handlamp is provided with a depending clip element for belt mounting, and the said clip element cooperates with other portions of the unique handlamp configuration to provide for varying the path of travel of an emitted light beam in desired directions of angularity.

A charging interface component of unique design cooperates with the handlamp configuration to insure that electrical contact between charging circuit means and battery means is reliably maintained.

BRIEF DESCRIPTION OF THE DRAWINGS

FIG. 15 is a perspective view of the apparatus of FIG. 14.

FIG. 16 is a side elevational view, partially broken away, of the handlamp of the invention engaged with the charging means of FIGS. 15 and 16.

DETAILED DESCRIPTION OF THE INVENTION

Figure 1:
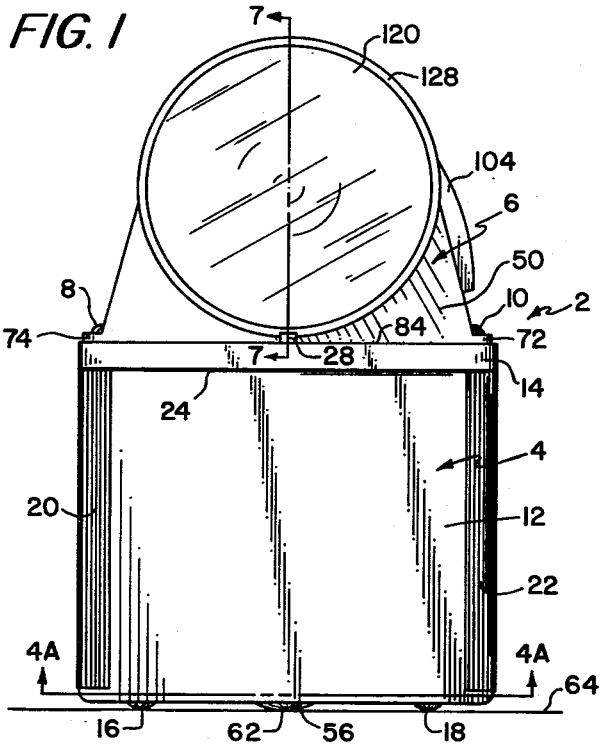
FIG. 1 is a front elevational view of a utility handlamp of the invention, resting in an upright position on a horizontal surface.

Referring in detail to the drawings, FIGS. 1–4, inclusive, are elevational views of a utility handlamp of the invention, which handlamp is generally denoted by the arrow 2. Handlamp 2 includes battery jar means, generally denoted by the arrow 4, and enclosure means generally denoted by the arrow 6. Enclosure means 6 may be detachably secured to battery means 4 by screws 8 and 10, for example.

Figure 3:
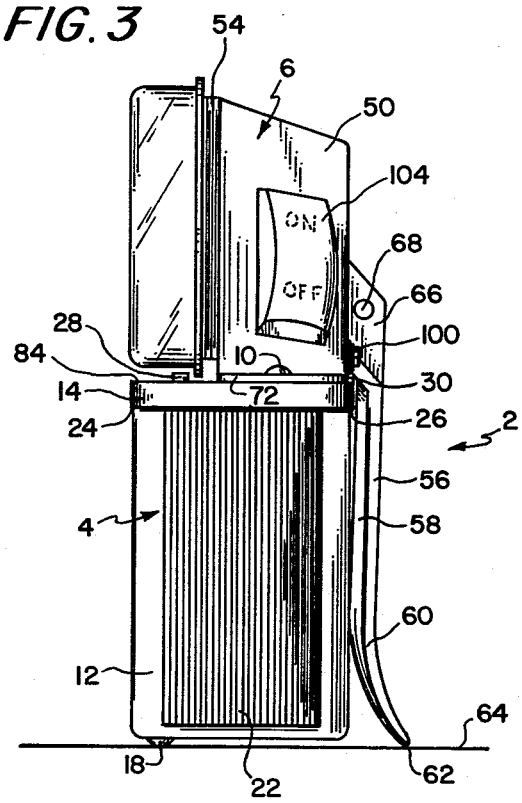
FIG. 3 is a side elevational view of the apparatus of FIG. 1.
Figure 4:
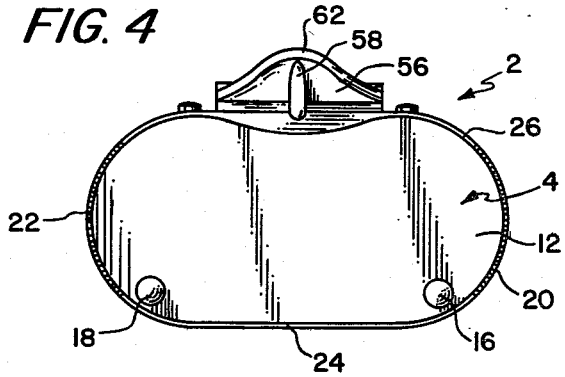
FIG. 4 is a bottom view of the handlamp of the invention.
Figure 4A:
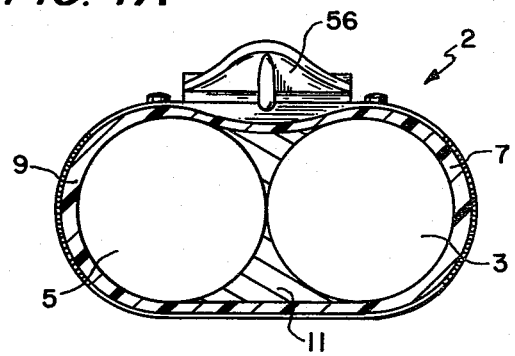
FIG. 4A is a cross-section, taken along the line 4A—4A of FIG. 1.

Battery jar means 4 comprises a plastic battery jar in which cylindrical battery cells as 3 and 5 may be received in substantially fixed relationship and held in place by a foam material 11 or other suitable filler means as is more clearly shown in FIG. 4A. The battery jar comprises two component parts (FIGS. 1–3), a receptacle portion 12 and a cover portion 14, which cover portion may be affixed to an open upper end of the receptacle portion 12 by means of solvent cementing, adhesive, ultrasonic or heat welding or the like to contain the cells within the jar. Receptacle portion 12 further presents supporting feet 16 and 18, and is formed with adjacent substantially barrel-shaped wall portions 7 and 9 which connect the front and rear sides of the jar and, which may have vertically grooved external gripping surfaces 20 and 22. The cells as 3 and 5 are retained in substantially fixed relationship to the inner surfaces of these barrel-shaped wall portions. Cover portion 14 may be formed slightly larger than receptacle portion 12 such that cover portion 14 provides overhanging lips at 24 and 26 to further facilitate gripping of the handlamp 2.

Figure 5:
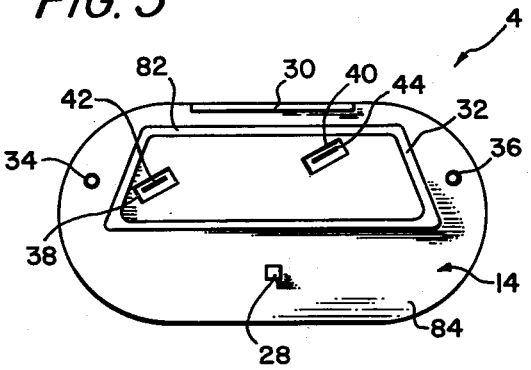
FIG. 5 is a plan view of battery means for the handlamp of the invention.

Battery jar means 4 and, in particular, cover portion 14, is more clearly shown in FIG. 5. In this figure it will be noted that cover portion 14 presents internally threaded inserts 34 and 36 in which the screws 8 and 10 earlier noted respectively may be engaged. Also presented in cover portion 14 are through holes 38 and 40, through which are located positive and negative battery connecting terminals 42 and 44, which terminals are connected electrically to the battery cells as 3 and 5 contained within battery means 4.

Cover portion 14 also presents, at an upper surface thereof, an upwardly extending focus stop projection 28, an upwardly extending extension rib 30, as well as upwardly extending continuous retaining wall 32.

Figure 6:
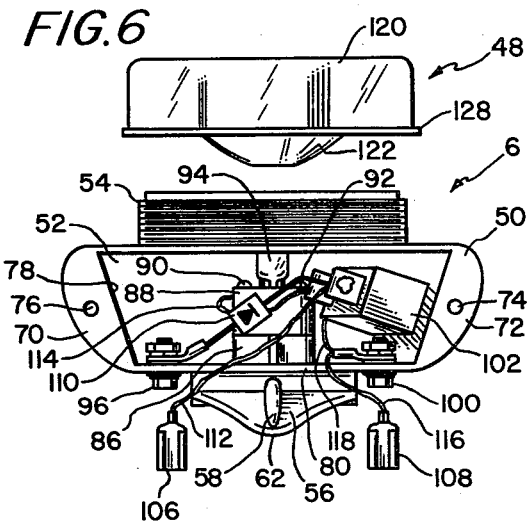
FIG. 6 is a bottom view of enclosure means of the handlamp of the invention, showing optical control means in separated relationship thereto and showing electrical components.

Enclosure means 50, as viewed from an underside thereof and as shown in FIG. 6, which presents an interior space 52 in which light source means 94 and other associated electrical components may be received. The enclosure means 50 is further formed with a tubular extension on which is located optical control means generally denoted by the arrow 48. These two parts (50 and 48) are shown in separated relationship in FIG. 6.

Figure 2:
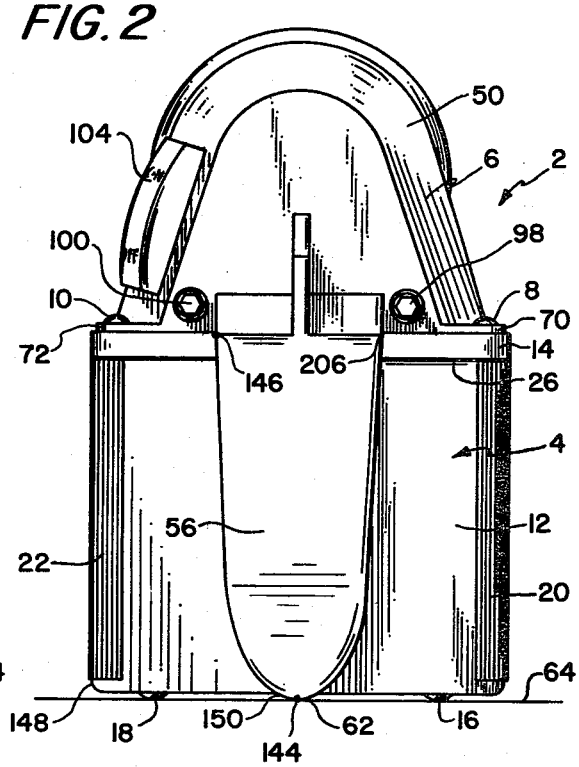
FIG. 2 is a rear elevational view of the apparatus of FIG. 1.

As shown in FIG. 6, the tubular extension is designated by numeral 54 and has an outer periphery in threaded engagement with the optical control means. Projecting outwardly and extending downwardly from a rear surface of enclosure body 50 is resilient clip means 56 which is formed integrally with the enclosure body. A stiffening rib 58 may be formed on an inner surface of clip element 56. At its lower end clip element 56 may be formed with an outward bend, as indicated by numeral 60 in FIG. 3, to facilitate entry of a belt member between clip element 56 and battery jar means 4. The lower extremity 62 of clip means 56 is located such that it cooperates with the bottom parts of supporting feet 16 and 18 to provide a stable, three-point support for handlamp 2 when it is placed on a surface 64 in an upright position, as is shown in FIGS. 1–3 inclusive. Extending upwardly from the top of clip element 56 and outwardly from a rear surface of enclosure body 50 is support flange 66 (FIG. 3), which may present a hole 68 through which a lanyard may be fastened if desired.

Referring again to FIG. 6, enclosure body 50 further presents opposed outwardly extending mounting flanges 70 and 72, through which are located holes 74 and 76. Screws 8 and 10 earlier noted respectively may be received through these holes 74 and 76 to engage with threaded inserts 34 and 36 in battery jar means 4, thereby to detachably secure enclosure body 50 to battery jar means 4.

Figure 7:
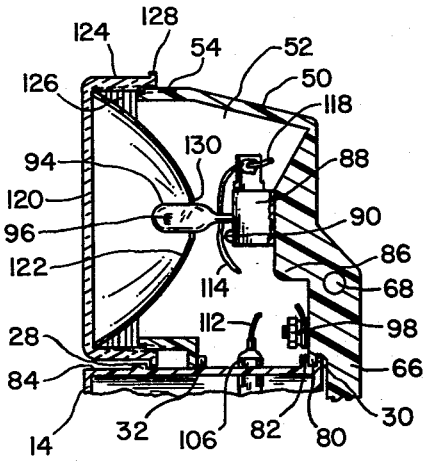
FIG. 7 is a partial cross-section, taken generally along the line 7—7 of FIG. 1.

Enclosure body 50 further presents, at its lower portion, mating edges whose inner periphery 78 is complementary to the outer periphery of retaining wall 32 of cover portion 14 (FIG. 5) and is sized to be engaged in fitted relationship therearound. In addition, rear wall portion 80 of enclosure body 50 (FIG. 6) is sized so as to be received in fitted relationship between a rear portion 82 of retaining wall 32 (FIG. 5) and extension rib 30 of cover portion 14. This relationship of parts, shown in cross-section in FIG. 7, provides a tortuous path along which passage of foreign material (e.g. water or dust) into the interior of housing body 50 is inhibited.

Referring again to FIGS. 6 and 7, rib body 50 is provided, at an inner side thereof, with a mounting boss 86 including two internally threaded inserts (not shown). A socket body 88 is affixed to mounting boss 86 by means of two screws 90 and 92, which extend through socket body 88 and engage with the threaded inserts. Light source means 94, comprising a bulb member, may be detachably received in socket body 88 such that its filament 96 is located along the central axis of tubular extension 54, which axis coincides with the central longitudinal axis of light source means 94.

Enclosure body 50 is further provided with positive and negative charging contact elements denoted by numerals 98 and 100, respectively. In the configuration shown, these contact elements comprise bolts extending through rear wall portion 80 and affixed thereto by nuts.

In addition, enclosure body 50 may be provided, on an inner surface thereof, with single-pole single-throw on-off switch component 102, which may be protectively enclosed on an outer side of enclosure body 50 by a rubber "boot" 104 (FIGS. 1–3) to preclude water entry. Also provided are positive and negative connectors 106 and 108, respectively, which mate with terminals 42 and 44 in detachable relationship therewith.

Figure 8:
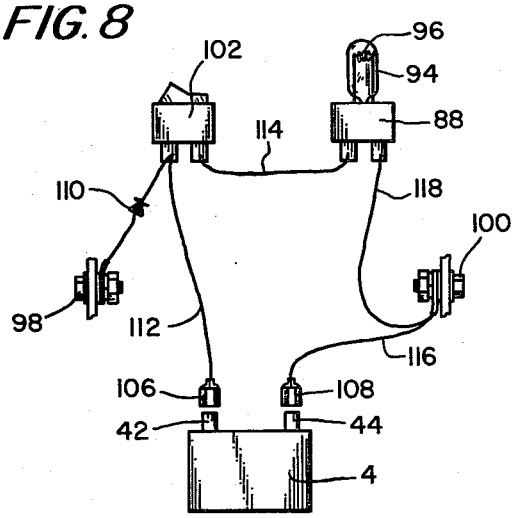
FIG. 8 is an electrical connection diagram showing the electrical components of FIG. 6.

Details of the electrical circuitry enclosed in enclosure body 50 are illustrated in diagrammatic form in FIG. 8. Positive charging contact element 98 is connected through blocking diode 110 to one terminal of switch component 102, and thence via wire 112 to positive connector 106. The other terminal of switch component 102 is connected, via wire 114, to one terminal of socket body 88 and thus to filament 96 of light source means 94. Negative charging contact element 100 is connected, via wire 116, to negative female battery connector 108 and also, via wire 118, to the other terminal of socket body 88 and thus to filament 96 of light source means 94.

Figure 9:
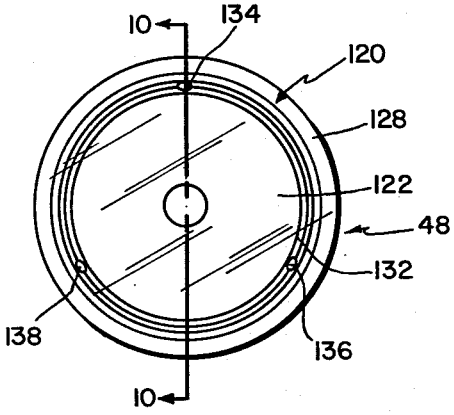
FIG. 9 is a rear elevational view of optical control means for the handlamp of the invention.
Figure 10:
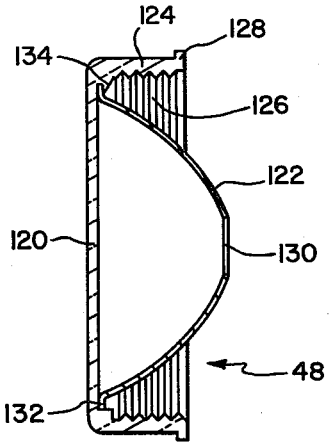
FIG. 10 is a cross-sectional view taken along the line 10—10 of FIG. 9.

Optical control assembly 48, more clearly shown in FIGS. 9 and 10, comprises a transparent plastic light transmitting member 120 and substantially parabolic reflector element 122. Light transmitting member 120 is provided with a tubular bezel ring 124, threaded at its inner side 126 in a manner complementary to and engageable with threads on tubular extension 54 of enclosure body 50. Bezel ring 124 is also provided, at its open end, with radially projecting rim 128.

Reflector element 122 is provided at its center with a hole 130 through which light source means 94 may extend, as shown in FIG. 7. Reflector means 122 is further provided, at its outer rim, with a flange portion 132, which may be employed to affix reflector element 122 to light transmitting member 120. Such attachment may be made, for example, by heat flowing a portion of plastic light transmitting member 120 over reflector flange portion 132 at various locations such as 134, 136 and 138 as shown in FIG. 9, or attachment may be realized by an adhesive or by other means.

With reflector element 122 so affixed to light transmitting member 120 and together with the threaded bezel ring extension comprising optical control assembly 48, and with said optical control assembly 48 engaged with tubular extension 54 as shown in FIG. 7, it will be apparent that rotation of light transmitting member 120 of optical control assembly 48 will cause optical control assembly 48 to move inwardly or outwardly on threaded tubular extension 54 in a path of travel along the central longitudinal axis of light source element 94. Reflector means 122 is substantially parabolic and has a focal point which lies in this central longitudinal axis. Filament 96 of light source means 94 also lies in this central longitudinal axis. Since reflector element 122 is affixed to light transmitting member 120 it is carried along with the said inward or outward motion, and thus the location of its focal point will also move inwardly or outwardly in this axis. The relative distance between filament 96 and the focal point defines the degree of focus of an emitted light beam, and when the focal point is coincident with the filament 96 the said beam is in focus with the path of travel of emergent light rays being parallel to the said central longitudinal axis. Thus, with the arrangement of parts described above, an emitted light beam may be focused with ease by rotation of optical control assembly 48, or may be unfocused by continued or by reversed rotation.

In luminaire apparatus of the type described, which may be intended for use under hazardous conditions, it may be a desirable objective to insure that the optical control assembly cannot be accidentally removed, or to limit the extent of focus adjustment to some degree. Therefore, some means for limiting the outward motion of optical control assembly 48 may be required.

Figure 11:
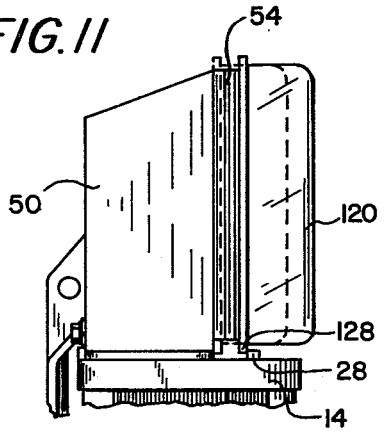
FIG. 11 is a partial side elevational view similar to FIG. 3 but of an opposite side, showing extremes of adjustment.

The handlamp apparatus of the invention presents such means, comprising vertically extending stop member 28 on cover portion 14 of battery jar means 4, arranged to cooperate with the radially projecting rim 128 of bezel ring 124 earlier disclosed. FIG. 11 illustrates diagrammatically the function of this combination of parts.

In FIG. 11 light transmitting means 120 is depicted in dotted lines in its farthest inward position, and in solid lines in its restricted, farthest outward position. In this farthest outward position an outer surface of rim 128 has been brought into contact, by rotation of light transmitting means 120 along threaded tubular extension 54, with an inner surface of stop member 28. Further rotation of light transmitting means 120 in a direction such as would cause additional outward movement is thereby precluded, and thus the aforementioned objective has been realized.

With this arrangement of parts it is necessary to remove enclosure body 50 from battery jar means 4 in order to replace light source means 94; this is easily accomplished with removal of screws 8 and 10. It is also necessary to design the various parts including reflector means 122, light transmitting member 120, light source means 94 and tubular extension 54 such that the focal point of reflector element 122 coincides with filament 96 of light source means 94 at some position of optical control assembly 48 between the two extremes of position illustrated in FIG. 11.

Figure 12:
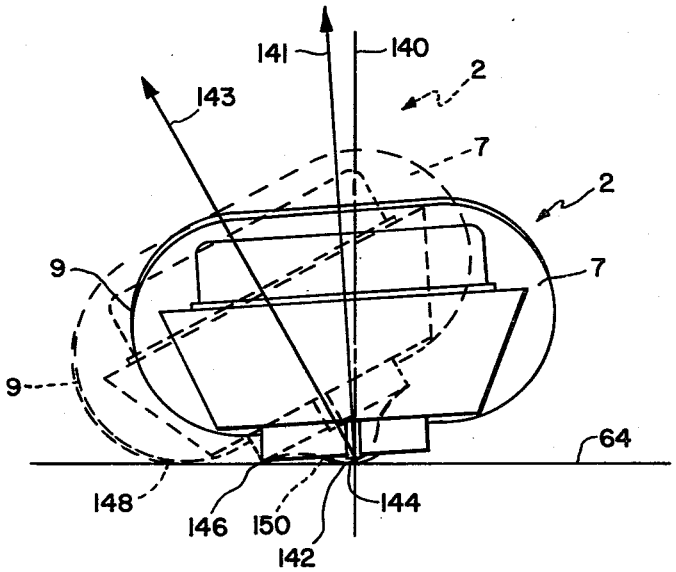
FIG. 12 is a diagrammatic representation illustrating positions of light emission for the handlamp of the invention, lying on its back upon a supporting surface.

The handlamp apparatus of the invention also provides a plurality of stable positions of light emission when lying on its back, thus allowing the path of travel of an emitted light beam to be varied in desired directions of angularity such that the light beam may be directed toward an overhead task without placing the user in the path of the light beam. FIG. 12 illustrates diagrammatically these positions of light emission.

One position, in which an emitted light beam 141 deviates only slightly from a line 140 drawn perpendicular to a surface 64, is shown in solid lines in FIG. 12. In this position the handlamp 2 is supported on surface 64 on clip portions 142, 144, and 146. Portions 144 and 146 are located at the lower end of clip 5, while clip portion 142 is located on the clip part 66, as is most clearly shown in FIG. 2. A second position, in which an emitted light beam 143 extends at an angle to perpendicular line 140, is shown in dotted lines in FIG. 12; in this position handlamp 2 is supported on surface 64 by portions as 144 and 146 of the clip and a portion 148 of the barrel shaped portion 7, as is most clearly shown in FIG. 2. It is pointed out that a similar position of use angular disposition may be provided at an opposite side of the perpendicular line 140. The handlamp 2 may thus be rolled back and forth upon the clip 56 and barrel-shaped portions 7 and 9 to provide a plurality of stable positions of light emission, occurring at angles which may be of use by a user such as a fireman looking at an overhead area.

Figure 13:
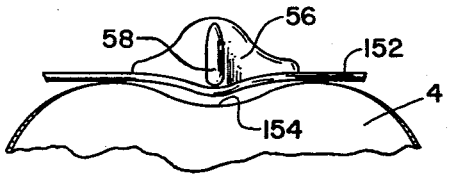
FIG. 13 is a partial bottom view illustrating the handlamp of the invention mounted on a resilient belt member.

As earlier disclosed barrel-shaped wall portions 7 and 9 are separated at a rear surface of the battery jar 4 by a vertically recessed portion 154. When the handlamp of the invention is mounted on a flexible support member such as a belt, pocket or other support member, clip means 56 cooperates with the said vertically recessed portion 154 to impart an undulating configuration to the said support member. FIG. 13 illustrates a belt member 152 which may be, for example, a firefighter's utility belt or airpack strap, confined between battery jar means 4 and clip means 56. Clip means 56 becomes deformed outwardly to some small degree by the thickness of belt member 152, and stiffening rib 58 of clip means 56 forces belt member 152 into recessed portion 154 to impart an undulating configuration to belt member 152 as referred to above.

Figure 14:
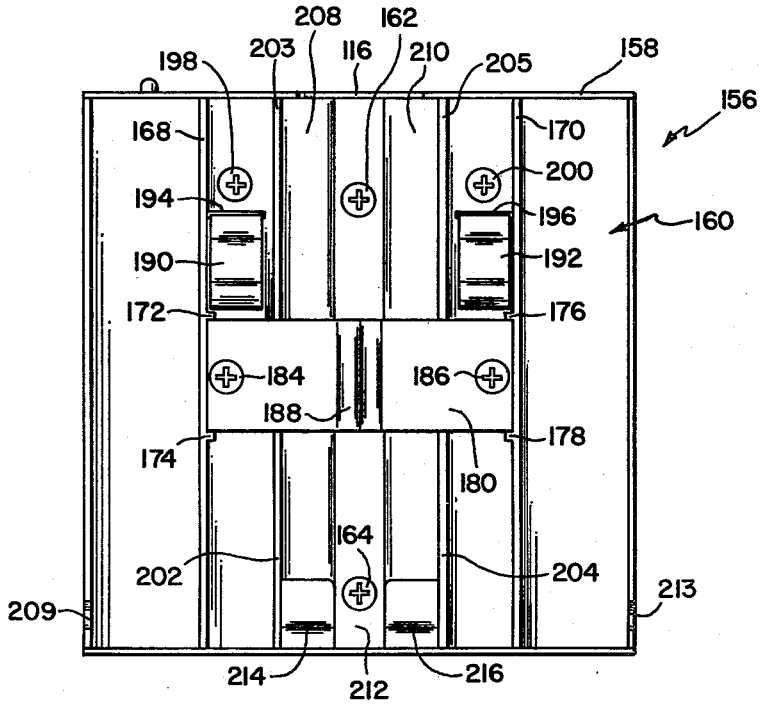
FIG. 14 is a front elevational view of charging means of the invention.

As previously disclosed there are battery cells as 3 and 5, which may be rechargeable in nature, provided in battery jar means 4. Charging contact elements 98 and 100 (FIG. 2 et al.) are provided on a rear surface of enclosure body 50, and these elements cooperate with charging means to charge the cells as 3 and 5. A preferred form of charging means is illustrated in FIGS. 14 and 15, and is generally denoted by the arrow 156.

Charging means 156 comprises a casing 158 containing charging circuit means of suitable nature (not shown) and the casing may be fabricated from metal or formed of a plastic material, and has supported thereon a charging interface component 160 which, in the preferred embodiment, is formed from a plastic or other electrically insulating material. Charging interface component 160 may be fastened to casing 158 by means of bolts as 162 and 164.

An upper side of casing 158 may be relieved at notch 166 to allow passage thereby of lower extremity 62 of clip means 56 of the handlamp apparatus (FIGS. 1–3).

Referring again to FIGS. 14 and 15, a front wall of charging interface component 160 presents two vertical ribs 168 and 170, each of which presents two projections 172, 174 and 176, 178 respectively. Portions of the said front wall lying between projections 172 and 174 and between projections 176 and 178 (indicated by numeral 182 in FIG. 15) are built out slightly to provide bearing surface for retaining bar 180, which bar may be attached to interface component 160 by means of bolts 184 and 186. In a preferred embodiment retaining bar 180 is fabricated from a rigid material such as metal, and may include a V-shaped undulation 188 to accommodate stiffener rib 58 of clip element 56 of the handlamp of the invention (FIG. 3 et al).

Spring-loaded positive and negative charging contacts 190 and 192, respectively (FIGS. 14 and 15), are located on the front wall of interface component 160 adjacent to ribs 168 and 170, respectively. These contacts 190 and 192 may extend into the interior of charging means 156 by way of slots 194 and 196, respectively, through interface component 160. Contacts 190 and 192 may be fastened in place by means of bolts 198 and 200, respectively, and electrical connection of the charging circuitry may be made to contacts 190 and 192 by means of these same bolts 198 and 200.

Charging interface component 160 may be recessed slightly to provide spaced apart bearing surfaces 202 and 204, and may be further recessed at portions 208 and 210, and still further recessed at portion 212. The recessed portions 202, 204, 208, 210 and 212 constitute channel means, across which retaining bar 180 may be transversely supported to define a passageway through which clip means 56 of the handlamp apparatus (FIGS. 2–3 et al.) may be received.

When a handlamp of the invention is engaged with charging means 156, depending clip means of the said handlamp is received in the said passageway, as is illustrated in FIG. 16. Each of the portions 202, 204, 208, 210 and 212 of the channel means performs some function in this engagement.

Surfaces 202 and 204 provide bearing surfaces as well as guide edges 203 and 205; during engagement, points 206 and 146, located at an upper portion of clip element 56 (FIG. 2), are received against these surfaces and edges which guide and support the handlamp apparatus. Portion 212 (FIGS. 14–15) recesses the heads of bolts 162 and 164 sufficiently so as to allow passage thereby of the lower extremity 62 of clip element 56 (FIG. 3).

Recessed portions 208 and 210 (FIGS. 14–16) are provided at their lower ends with V-shaped shoulder portions 214 and 216, respectively, which portions provide angled ramps for engagement with the lower end of clip means 56, thereby to hold handlamp 2 in place as shown in FIG. 16.

V-shaped shoulder portions 214 and 216 also cooperate with retaining bar 180 and bearing surfaces 202 and 204 to impart and inward bend to clip means 56. This inward bend, by lever action, forces charging contact elements 98 and 100 into intimate abutting relationship with charging contacts 190 and 192, respectively, thus maintaining compressively electrical contact between these parts under varying conditions of use, e.g. vibration, etc.

It is pointed out that, with charging means 156 firmly affixed to a substantially horizontal mounting surface 64, handlamp 2 is suspended such that supporting feet 16 and 18 are located slightly above this surface 64. Alternatively, charging means 156 may be mounted on a substantially vertical surface as 218 by means of bolts as 220, 222 extending through holes in mounting brackets as 224, 226 provided on a rear surface of casing 158. A hole 207, including grommet means 209, may be provided at one side of charging means 156, through which a wire may be received to electrically connect the charging circuitry to an appropriate power source. A second hole and grommet 213 may be provided at an opposite side to facilitate connection of a plurality of charger means in ganged relationship.

We claim:

1. A utility hand lamp construction including a battery jar formed with a front side, a rear side and barrel shaped end portions joining the front and rear sides, a portion of the rear side lying between the barrel shaped portions being vertically recessed, battery cell members received in the battery jar and being electrically connected to one another internally of the battery jar to provide negative and positive battery terminals, a battery jar cover permanently secured to the top of the battery jar having positive and negative battery terminals extending therethrough, an enclosure body detachably fastened at the upper side of the battery jar cover, resilient clip means integrally formed with the enclosure body and extending downwardly in spaced relation to the said vertically recessed portion of the rear side of the battery jar for resiliently securing the hand lamp to a supporting member in suspended relationship therewith and to force a flexible supporting member into an undulating configuration to increase frictional engagement, the upper side of the battery jar cover being formed with a continuous retaining wall lying in spaced relation to the edge of the battery jar cover, the enclosure body being formed at an under side thereof with continuous mating edge means which is fitted around the said retaining wall, light source means received in the enclosure body and electrically connected through a switch to the negative and positive battery terminals, said retaining wall and mating edge means of the enclosure body cooperating to locate the resilient clip means in a desired spaced relationship to the vertically recessed portion of the battery jar and to resist displacement of the enclosure body on the battery jar cover and to inhibit entry of foreign material into the interior of the enclosure body.

2. The invention of claim 1 in which the upper side of the battery jar cover is further formed with a rib portion lying in spaced apart relation to a portion of the retaining wall to define a space into which a portion of the mating edge of the enclosure body may be fitted.

3. The invention of claim 1 in which the battery cell members are rechargeable and battery charging means is attached at a rear side of the enclosure body and charging contact elements extending through a rear wall of the enclosure body are electrically connected to the said positive and negative battery terminals.

4. A utility hand lamp construction including a battery jar formed with a front side, a rear side and barrel shaped portions joining the front and rear side and a portion of the rear side lying between the barrel shaped portions being vertically recessed, battery cell members received in the battery jar and being electrically connected to one another internally of the battery jar to provide negative and positive battery terminals, a battery jar cover permanently secured to the top of the battery jar having positive and negative battery terminals extending therethrough, an enclosure body detachably fastened at the upper side of the battery jar cover, resilient clip means integrally formed with the enclosure body and extending downwardly in spaced relation to the said vertically recessed portion of the rear side of the battery jar for resiliently securing the hand lamp to a supporting member in suspended relationship therewith, the upper side of the battery jar cover being formed with a continuous retaining wall lying in spaced relation to the edge of the battery jar cover, the enclosure body being formed at an under side thereof with continuous mating edge means which is fitted around the said retaining wall, light source means received in the enclosure body and electrically connected through a switch to the negative and positive battery terminals, said retaining wall and mating edge means of the enclosure body cooperating to locate the resilient clip means in a desired spaced relationship to the vertically recessed portion of the battery jar to resist displacement of the enclosure body on the battery jar cover and to inhibit entry of foreign material into the interior of the enclosure body, said battery cell members being rechargeable and battery charging means attached at a rear side of the enclosure body and charging contact elements extending through a rear wall of the enclosure body are electrically connected to the said positive and negative battery terminals, and said charging means including a horizontally disposed retaining bar and the resilient clip means being engageable with the said horizontally disposed member for maintaining the charging means in contact with the electrical charging contact elements.

5. The invention of claim 4 in which the charging means includes spring loaded contacts which are engagaged with the charging contact elements on the enclosure body.

6. The invention of claim 5 in which an interface of the charging means is formed with projections which engage and displace the lower end of the clip means when said clip means is fully engaged with the horizontally disposed retaining bar support member thereby to resiliently urge the charging contact elements on the enclosure body against the spring-loaded contacts of the charging means.

7. The invention of claim 6 in which the said resilient clip means is formed with a vertically disposed stiffener rib at an inner surface thereof, and the said horizontally disposed retaining bar is formed with a substantially V-shaped portion into which the said stiffener rib is engaged and said V-shaped portion being operative to maintain alignment of the charging contact elements on the enclosure body with spring-loaded contacts on the charging means.

8. A utility hand lamp construction including a battery jar formed with a front side, a rear side and barrel shaped end portions joining the front and rear sides, a portion of the rear side lying between the barrel shaped portions being vertically recessed, battery cell members received in the battery jar and being electrically connected to one another internally of the battery jar to provide negative and positive battery terminals, a battery jar cover permanently secured to the top of the battery jar having positive and negative battery terminals extending therethrough, an enclosure body detachably fastened at the upper side of the battery jar cover, resilient clip means integrally formed with the enclosure body and extending downwardly in spaced relation to the said vertically recessed portion of the rear side of the battery jar for resiliently securing the hand lamp to a supporting member in suspended relationship therewith, the upper side of the battery jar cover being formed with a continuous retaining wall lying in spaced relation to the edge of the battery jar cover, the enclosure body being formed at an under side thereof with continuous mating edge means which is fitted around the said retaining wall, light source means received in the enclosure body and electrically connected through a switch to the negative and positive battery terminals, portions of the clip means being operable to support the utility hand lamp on a substantially horizontal surface in a position to direct a beam of light from the light source in a direction substantially perpendicular to the supporting surface, and the said barrel shaped end portions providing additional bearing portions engageable with the supporting surface and cooperating with rear portions of the clip means to provide for stable positions in which the hand lamp is arranged in angularly disposed relationship to the supporting surface so as to direct a beam of light from the light source along a path of travel which occurs at desired angles with respect to the supporting surface.

9. A utility hand lamp construction including a battery jar having battery cell members secured therein, an enclosure body detachably fastened to the battery jar, said enclosure body having socket means included therein and electrically connected through a switch to the battery cell members, light source means received in the socket means and the said enclosure body being formed with a tubular extension communicating with the interior of the enclosure body and having a threaded outer surface, an optical control assembly including a light transmitting member and a substantially parabolic reflector element attached to the light transmitting member, the said reflector element having an aperture therein through which the said light source means may be located, and an internally threaded bezel ring formed integrally with the light transmitting member and being engageable with the threaded outer surface of the said tubular extension, and the said optical control assembly being rotatable on the threaded outer extension to move the optical assembly inwardly and outwardly along its central axis thereby to vary the location of the said focal point of the reflector element with respect to the light source.

10. The invention of claim 9 in which the bezel ring includes a radially projecting rim, and the said battery jar includes a vertically extending stop member at an upper side thereof engageable with the said stop member to limit outward travel of the optical control assembly and prevent accidental removal of the optical control assembly.

* * * * *